United States Patent [19]

Maeda et al.

[11] Patent Number: 4,745,027

[45] Date of Patent: May 17, 1988

[54] FIBER HAVING HIGH DENSITY AND ROUGHENED SURFACE

[75] Inventors: Katsura Maeda; Takao Akagi, both of Kurashiki; Masanori Sato, Toyono; Shinji Yamaguchi, Kurashiki, all of Japan

[73] Assignee: Kuraray Co., Ltd., Kurashiki, Japan

[21] Appl. No.: 899,979

[22] Filed: Aug. 25, 1986

[30] Foreign Application Priority Data

Sep. 4, 1985 [JP] Japan ..... 60-197042

[51] Int. Cl.[4] ..... D02G 3/00; C08K 3/32

[52] U.S. Cl. ..... 428/372; 524/416; 524/423; 524/425; 524/433; 524/437

[58] Field of Search ..... 524/416, 423, 425, 433, 524/437; 428/372

[56] References Cited

U.S. PATENT DOCUMENTS

| | | | |
|---|---|---|---|
| 3,310,532 | 3/1967 | Kazawa et al. | 524/423 |
| 3,784,520 | 1/1974 | Hoeschele | 525/533 |
| 4,254,182 | 3/1981 | Yamaguchi et al. | 428/400 |
| 4,293,636 | 10/1981 | Okuya | 430/908 |
| 4,444,931 | 4/1984 | Lu et al. | 524/423 |
| 4,450,200 | 5/1984 | Iwato et al. | 524/423 |
| 4,521,560 | 6/1985 | Breitenfellner | 524/423 |
| 4,522,873 | 6/1985 | Akagi et al. | 428/283 |

FOREIGN PATENT DOCUMENTS

| | | | |
|---|---|---|---|
| 2251708 | 4/1974 | Fed. Rep. of Germany | 524/423 |
| 2312541 | 12/1976 | France | 524/423 |
| 54-8649 | 1/1979 | Japan | 524/423 |
| 59-133246 | 7/1984 | Japan | 524/423 |
| 6079931 | 5/1985 | Japan | 524/423 |
| 1104089 | 2/1968 | United Kingdom | 524/423 |

*Primary Examiner*—Joseph L. Schofer
*Assistant Examiner*—N. Sanofim
*Attorney, Agent, or Firm*—Kramer, Brufsky & Cifelli

[57] ABSTRACT

There is provided an improved polyester fiber said improvement comprising (a) said fiber containing a density increasing amount of particles having a specific gravity higher than the polyester polymer from which the fiber is made and (b) a roughened surface thereby providing improved drape and silhouette to woven and knitted fabrics made therefrom.

2 Claims, 1 Drawing Sheet

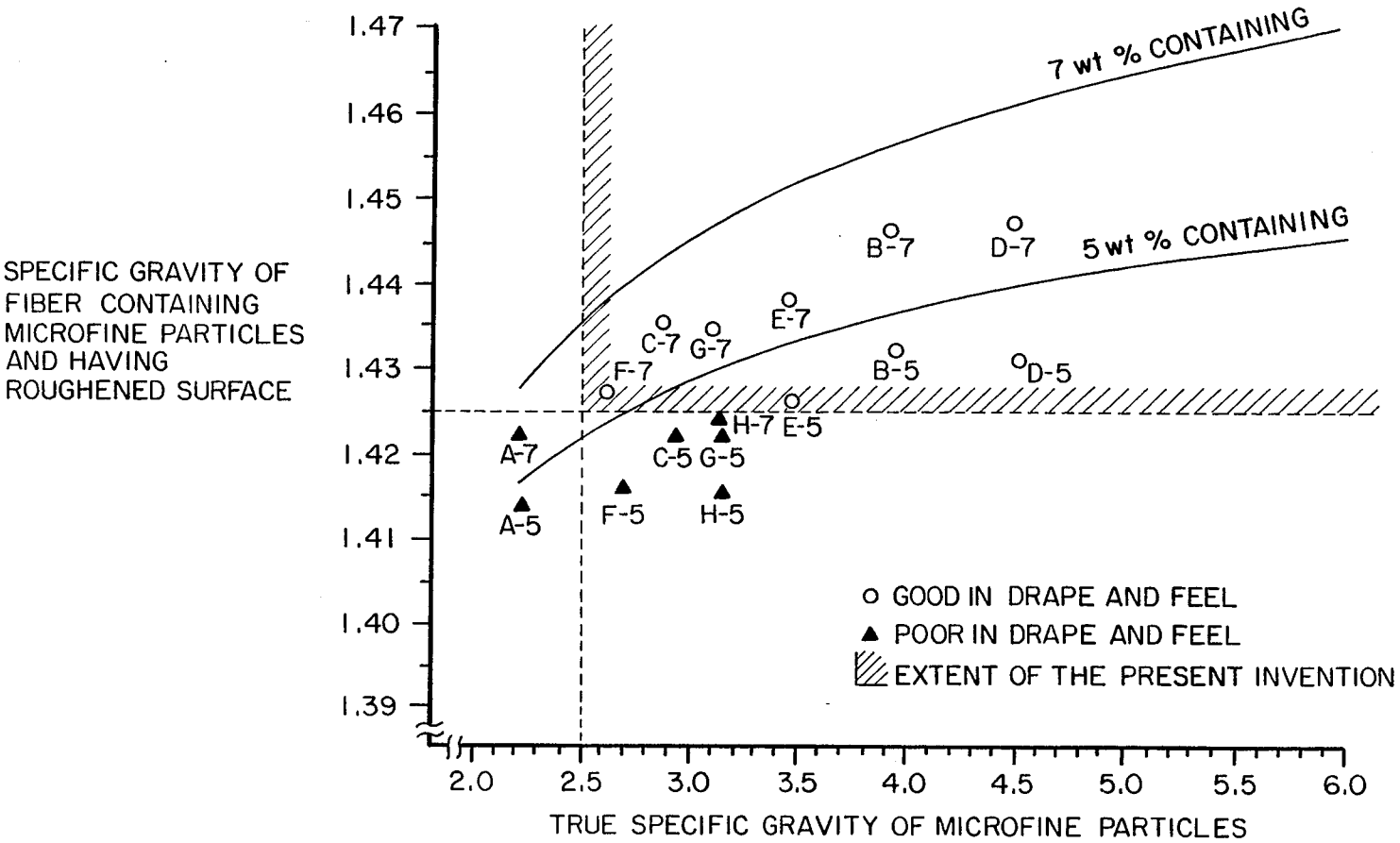
7 wt % CONTAINING
5 wt % CONTAINING
B-7
D-7
B-5
D-5
E-7
H-7
E-5
C-7
G-7
C-5
G-5
F-7
H-5
F-5
A-7
A-5
O GOOD IN DRAPE AND FEEL
▲ POOR IN DRAPE AND FEEL
EXTENT OF THE PRESENT INVENTION
SPECIFIC GRAVITY OF FIBER CONTAINING MICROFINE PARTICLES AND HAVING ROUGHENED SURFACE
1.47
1.46
1.45
1.44
1.43
1.42
1.41
1.40
1.39
2.0
2.5
3.0
3.5
4.0
4.5
5.0
5.5
6.0
TRUE SPECIFIC GRAVITY OF MICROFINE PARTICLES

FIBER HAVING HIGH DENSITY AND ROUGHENED SURFACE

BACKGROUND OF THE INVENTION

1. Field of the Invention

The present invention relates to a polyester fiber the woven fabrics and knitted fabrics of which provide good drape and silhouette comparable to or better than rayon fabrics.

2. Description of the Prior Art

Polyester fiber has become a prominent synthetic fiber in garment use because of its favorable properties such as wash-and-wear, heat setting and easy care. These properties have improved because of improvement of raw materials and processing technology. Despite these advantages, fabrics made therefrom have heretofore suffered from a less than adequate feel and hand as compared to natural fibers. A variety of techniques have heretofore been proposed to overcome this disadvantage. Nevertheless, there are still many unsolved problems regarding the drape and silhouette of polyester woven and knitted fabrics.

Conventional means used to improve drapes in polyester woven and knitted fabrics are to lower the diameter of the fiber or to increase the alkali-soluble matter contained therein. According to these means, the flexibility and shear rigidity of polyester fiber are reduced and this leads to an improved drape. On the other hand, the reduction of rigidity makes the fabrics flexible to such an extent that these conventional means are of no practical use. These and other disadvantages of the prior art are overcome by the instant invention which in one of its more broader aspects comprises an improved polyester fiber, said improvement comprising (a) said fiber containing a density increasing amount of particles having a specific gravity higher than the polyester polymer from which the fiber is made and (b) a roughened surface thereby providing improved drape and silhouette to woven and knitted fabrics made therefrom.

SUMMARY OF THE INVENTION

Accordingly, it is an object of the present invention to provide a polyester fiber, the woven and knitted fabrics made therefrom exhibiting good drape and silhouette.

This invention is a result of our intensive research into a polyester fiber which can be made into woven and knitted fabrics having good drape and silhouette as well as good stiffness, hand, and gloss comparable to those of natural fibers. Our research led to the finding that the above-mentioned object is achieved by a polyester fiber having a high density and roughened surface.

BRIEF DESCRIPTION OF THE DRAWING

The FIGURE is a graph showing the relationship between the specific gravity of fiber containing microfine particles and having a roughened surface and the true specific gravity of microfine particles.

DETAILED DESCRIPTION OF THE INVENTION

The specific gravity of a synthetic polymer depends almost entirely on the skeleton of the molecular chain and the manner in which its crystallization takes place. Therefore, in the case of polyester fiber it is only possible to change the specific gravity of polymer in the limited range of 1.36 to 1.41. One conceivable way of increasing the specific gravity of a polymer is to incorporate in the polymer microfine particles having a specific gravity higher than that of the polymer. However, merely increasing the specific gravity of a fiber does not lead to improved feel and handling properties of the fiber. For improved feel and hand, it is necessary to impart minute recesses and projections in the surface of the fiber. These surface irregularities delicately change the coefficient of static and dynamic friction between fibers, thereby improving the feel and hand of the fibers as a whole.

There are several known roughening methods for imparting surface irregularities to the polyester fiber for the improvement of feel and hand. The surface roughening technique, however, is difficult to perform. In cases where the recesses and projections formed on the fiber surface are large, the fiber gives a whitish pastel shade when the woven and knitted fabrics of the fiber are dyed. In cases where the recesses and projections on the fiber surface are extremely small (i.e.: in the order of a magnitude of wavelengths of light) they produce a color deepening effect or they cause the dyed product to have a depth of color. However, such extremely small surface irregularities are enlarged when the fabrics are rubbed together in the dyeing process, and such areas have a whitish appearance as compared with the undamaged areas. This uneven appearance diminishes the commercial value of the fabrics. In other words, the surface irregularities for the improvement of feel and hand of the polymer fiber should be made in such a way that the woven fabrics and knitted fabrics made of the fiber do not give a whitish pastel shade when dyed. Moreover, extremely small irregularities are preferable from the standpoint of the color deepening effect but they should be resistant to damage by rubbing.

Our research into this subject led to the finding that the specific gravity of polyester fiber can be increased and, at the same time, the feel and hand of polyester fiber can be improved only when the polyester fiber is incorporated with microfine particles having a high specific gravity and the polyester fiber is given surface irregularities of proper magnitude and density. It was also found that the microfine particles and surface irregularities according to this invention should preferably satisfy the following conditions.

The microfine particles having a specific gravity higher than that of the polyester polymer should have a true specific gravity higher than 2.5, preferably higher than 3.5, an average particle diameter smaller than 1 μm, and a refractive index lower than 2.0. When polyester fiber is incorporated with more than 4 wt% of the microfine particles, the polyester fiber is given a high specific gravity resulting in improved feel and hand.

The effect produced by increasing the specific gravity of fibers varies depending on the weight of the cloth and the textile weave. If woven fabrics and knitted fabrics of polyester fibers are to give the drape and silhouette as rayon cloths do, the polyester fiber should have a specific gravity higher than 1.425, preferably higher than 1.44. However, polyester fiber with a specific gravity higher than 1.60 is too heavy and produces a fiber with poor feel and hand.

In this invention the specific gravity of the fiber is measured by the density gradient tube method at 25° C., and the fibers used for measuring the specific gravity are oriented fibers and heat set fibers. The oriented fibers are prepared by drawing in the usual manner spun yarns at a rate of 0.65 to 0.75 of the maximum draw ratio, followed by heat treatment at 170° to 190° C. for 10 to 60 seconds. The heat set fibers are obtained from fabrics which have undergone heat setting or from false twist yarns which have undergone heat setting.

The microfine particles to be incorporated in the polyester fiber should have a refractive index lower than 2.0, preferably lower than 1.75 which is close to that of the polyester fiber. With microfine particles having a refractive index greater than this value, the dyed fabrics of the fiber incorporated with them look whitish because they scatter light. In addition, the microfine particles should have an average particle diameter smaller than 1 μm. Particles larger than this limit are liable to form large recesses on the fiber surface during the surface roughening process, the large recesses impart a pastel shade to dyed fabrics In the next step, the polyester fiber incorporated with microfine particles as mentioned above is treated with a solution capable of etching the polymer substrate. A solution of sodium hydroxide used for alkali treatment is adequate.

The microfine particles are not necessarily required to be soluble in the etching solution; rather they should preferably be inert to the etching solution so that the formation of extremely small irregularities is voided when the fiber surface is roughened. Etching takes place in the vicinity of each microfine particle where the polymer is not sufficiently oriented. The recess thus formed by etching has a length in the direction of the fiber axis and a breadth in the direction perpendicular to the fiber axis.

The length of each recess should be smaller than 10 μm but preferably greater than 2 μm, and the breadth of each recess should be greater than 0.3 μm but preferably smaller than 2 μm. The density of the recesses should be 5 to 100 per 100 square microns. The surface irregularities specified above impart good feel and hand to the woven and knitted fabrics of the polyester fiber having them. Such irregularities are less liable to damage in the dyeing process and hence prevent production of pastel or whitish areas on the woven and knitted fabrics and help to produce woven and knitted fabrics with good drape and silhouette.

Recesses longer than about 10 μm or wider than about 2 μm give rise to a pastel shade. Recesses narrower than about 0.3 μm and denser than about 100 per 100 square microns are liable to damage. Thus, these types of recesses are not desirable in this invention.

When woven or knitted fabrics are made of the polyester fibers having surface irregularities as specified above, they have good feel and hand without a waxy feeling, like that of rayon. If the fabrics are treated with a proper finish, they feel like natural fibers such as silk and wool. In addition, the increased specific gravity greatly contributes to the improvement in drape and silhouette.

The fiber of this invention having a high specific gravity and roughened surface may be obtained by incorporating microfine particles into the polymer when the polymer is being produced. Alternatively, it is also possible to cause microfine particles to separate out during the polymer synthesis or to disperse microfine particles into the molten polymer by the aid of a proper vehicle. Other methods known to those skilled in the art may be utilized.

Examples of the inert microfine particles having a refractive index lower than about 2.0 and a true specific gravity higher than about 2.5 include alumina, zircon, barium sulfate, calcium carbonate, magnesium oxide, aluminum phosphate, calcium phosphate and mixtures thereof. They should have an average particle diameter smaller than 1 μm, and should be added in an amount greater than about 4 wt% so that the fibers incorporated with them have a specific gravity greater than about 1.425. If the content is low, the fiber does not have the desired specific gravity. It was empirically concluded from the tests with a variety of microfine particles that it is generally necessary to add at least 4 wt% for the desired results. The specific gravity of the fiber increases in proportion to the amount of microfine particles added; however, the addition of greater than about 30 wt% adversely affects the spinnability. The specific gravity of the fiber should be lower than about 1.60 so that the fabrics made from it have good feel and hand.

The polyester fiber incorporated with microfine particles is treated with an etching solution for surface roughening as mentioned above. The incorporation of specific microfine particles increases the specific gravity of the polyester fiber and the etching treatment imparts minute irregularities to the surface of the polyester fiber.

The polyester fiber of this invention may be composed entirely of polyester incorporated with microfine particles. Alternatively, it may be skin-core conjugate fiber in which the sheath is composed of polyester incorporated with microfine particles and the core is composed of other polyester. Further, the composite polyester fiber of the side-by-side type can also be used. In the case of composite polyester fiber, the counter component may contain a metal (such as lead) or metal oxide having a high specific gravity or may be a high-density polymer such as polyvinylidene chloride.

Among the above-mentioned microfine particles, barium sulfate is most preferable because it imparts a high specific gravity to the polyester fiber and, at the same time, it helps form the desired surface irregularities.

The polyester fiber of this invention can be used to make part or all of the fabrics. In addition, it can be used in the form of filaments and staples. It can also be used in the form of monofilaments. The staples may be used alone or mixed with other fibers.

The polyester fiber of this invention is composed of polyester polymer is which polyethylene terephthalate accounts for more than 75% of the constituents. The polyester polymer may contain commonly used additives such as antistatic agent, antioxidant, delustering agent, dye and pigment, and flame retardant.

The invention is further illustrated by the following examples, which are not to be construed as limiting the present invention.

EXAMPLE 1

Ethylene glycol and barium sulfate (having an average particle diameter of 0.58 μm, a refractive index of 1.64, and a true specific gravity of 4.49, in 60% paste in water) were mixed in equal quantities (by weight). For complete dispersion, the mixture was stirred by using a vibration mill (model MB-1, made by San-ei Seisakusho) for 10 hours. The ethylene glycol containing barium sulfate was mixed with terephthalic acid and ethylene glycol in such quantities that the molar ratio of ethylene glycol to terephthalic acid is 1.5 and the content of barium sulfate in the polymer is 2 wt%, 4 wt%, 5 wt%, 7 wt%, 10 wt%, 20 wt%, and 30 wt%. After the addition of 400 ppm of $Sb_2O_3$, each mixture in the slurry form was fed over 2.5 hours to the esterification vessel kept at an internal temperature of 240° C. The reaction mixture was heated to 270° C. over 40 minutes to complete the reaction. The reaction product was transferred to the polymerization vessel kept at an internal temperature of 290° C. The vessel was gradually evacuated to 1 mm Hg and polymerization was carried out for about 3 hours. The resulting polymer was forced into water in the form of a strand under the pressure of nitrogen. The strand was cut into chips having an intrinsic viscosity of 0.65 to 0.75.

The barium sulfate-containing polyester chips thus obtained were made into a drawn yarn (75 denier, 36 filaments) by spinning and drawing in the usual way. The drawn yarn was woven into a Habutae fabric composed of the same warp and filling. The fabric sample underwent desizing, relaxation scouring, and heat setting (180° C., 60 seconds) in the usual way. Then, the fabric sample was treated with a 4% NaOH solution at 95° C. in the usual way until the weight of the fabric sample was decreased by 20%. The fabric sample was subjected to high-temperature dyeing (8% owf, with Dianix Navy Blue ER-FS, made by Mitsubishi Kasei Co., Ltd.), followed by ordinary finishing. The finished fabric was examined for external appearance, and feel and hand. The specific gravity of the fiber was measured, and the surface of the fiber was observed under a scanning electron microscope.

In comparative example, the same procedure as mentioned above was repeated except that barium sulfate was replaced by 0.5 wt% or 3 wt% of titanium oxide (having an average particle diameter of 0.2 μm, a refractive index of 2.49, and a true specific gravity of 4.20).

The results of the experiments are shown in Table 1. It is apparent from Table 1 that the fiber having a high gravity and surface irregularities according to this invention provide fabrics superior in appearance, drape, and feeling.

TABLE 1

| Fine particles | | Spinnability | Surface irregularities | | | | Specific gravity of fiber | Appearance | | Feeling | | |
|---|---|---|---|---|---|---|---|---|---|---|---|---|
| Name | Content | | Length (μm) | Breadth (μm) | Density per 100 μm² | Pitch of recesses | | Color tone | Delustering | Drape | Touch | Handle |
| $BaSO_4$ | 20% | good | 2–8 | 0.3–1.6 | 17–30 | 1.3 μm | 1.54 | good | best | best | best | good |
| $BaSO_4$ | 10% | good | 2–8 | 0.3–1.6 | 15–30 | 1.3 | 1.472 | good | best | best | best | good |
| $BaSO_4$ | 7% | good | 2–9 | 0.3–1.7 | 10–30 | 1.8 | 1.441 | good | best | best | best | good |
| $BaSO_4$ | 5% | good | 2–10 | 0.3–1.4 | 10–25 | 2 | 1.430 | good | good | good | best | good |
| $BaSO_4$ | 4% | good | 2–10 | 0.4–1.2 | 5–20 | 2 | 1.425 | good | good | good | fair | good |
| | | | | | Comparative Examples | | | | | | | |
| $BaSO_4$ | 2% | good | 2–10 | 0.4–1.2 | 3–5 | 3 | 1.405 | good | fair | fair | poor | poor |
| $BaSO_4$ | 30% | poor | — | — | — | — | 1.597 | | Unsuccessful to prepare samples | | | |
| $TiO_2$ | 3% | good | 1–6 | 0.3–1.5 | 10–20 | 1.3 | 1.420 | poor | good | fair | fair | poor |
| $TiO_2$ | 0.5% | good | 1–5 | 0.5–1.3 | 3–8 | 3.5 | 1.394 | good | poor | poor | poor | poor |

EXAMPLE 2

Ethylene glycol was mixed with each of the following powders in equal quantities.

| Name of powder | Average particle diameter | Refractive index | True specific gravity |
|---|---|---|---|
| Colloidal silica | 0.045 μm | 1.56 | 2.25 |
| Alumina | 0.2 | 1.76 | 3.97 |
| Calcium carbonate | 0.08 | 1.65 | 2.93 |
| Barium sulfate | 0.60 | 1.64 | 4.49 |
| Magnesium oxide | 0.5 | 1.72 | 3.50 |
| Aluminum metaphosphate | 0.6 | 1.7 | 2.26 |
| Calcium phosphate | 0.8 | 1.7 | 3.14 |

-continued

| Name of powder | Average particle diameter | Refractive index | True specific gravity |
|---|---|---|---|
| Calcium phosphate | 1.2 | 1.7 | 3.14 |

For complete dispersion of powder particles, the mixture was stirred by using a vibration mill as in Example 1 and further treated with ultrasonic vibrations. The resulting dispersion was diluted with methanol for measurement of average particle diameter. The data thus obtained are shown in the above table.

The ethylene glycol containing microfine particles was mixed with terephthalic acid and ethylene glycol in such quantities that the molar ratio of ethylene glycol to terephthalic acid is 1.5 and the content of microfine particles in the polymer is 7 wt%. After the addition of 400 ppm of $Sb_2O_3$, each mixture in the slurry form underwent esterification and polycondensaton in the same way as in Example 1. The resulting molten polymer was forced directly to a spinneret by a gear pump. Drawn yarns (75 denier, 24 filaments) were obtained by drawing in the usual way.

A filling-faced, 8 leaves satin weave was woven from each of the eight kinds of the polyester yarns prepared as mentioned above, as filling, and ordinary polyester filament yarns (50 denier, 36 filaments), as warp. The satin weave underwent desizing, relaxation scouring, and heat setting in the usual way. Then the satin weave was treated with an alkaline solution to decrease the weight by 25%. The satin weave samples were dyed all at once in the same batch by high temperature dyeing (12% owf, with Dianix Black HG-SE made by Mitsubishi Kasei Co., Ltd.) by using a circular dyeing machine. The dyed fabrics were examined for appearance and feel employing the organoleptic test. The results are shown in the FIG. 1.

EXAMPLE 3

The same procedure as in Example 2 was repeated except that the content of microfine particles in the polyester fiber was changed to 5 wt%. The results are shown in the FIGURE.

In the FIGURE, the abscissa represents the true density of microfine particles incorporated into the polyester fiber and the ordinate represents the specific gravity of the polyester fiber containing microfine particles and having surface irregularities. The symbol Δ denotes those samples which are good in drape and feel, and the symbol denotes those samples which are poor in drape and feel. The code numbers represent the name and amount of microfine particles used as follows:

| Name of powder | Average particle diameter | 7% content | 5% content |
|---|---|---|---|
| Colloidal silica | 0.045 μm | A-7 | A-5 |
| Alumina | 0.2 | B-7 | B-5 |
| Calcium carbonate | 0.08 | C-7 | C-5 |
| Barium sulfate | 0.6 | D-7 | D-5 |
| Magnesium oxide | 0.5 | E-7 | E-5 |
| Aluminum metaphosphate | 0.6 | F-7 | F-5 |
| Calcium phosphate | 0.8 | G-7 | G-5 |
| Calcium phosphate | 1.2 | H-7 | H-5 |

The two curves in the FIGURE represent the theoretical values of the specific gravity of the fiber containing microfine particles. The actual values in the examples are lower than the theoretical ones. Presumably, this is because voids are formed by the incorporation of microfine particles. In the case of microfine particles having an average particle diameter greater than 1 μm, the resulting polyester fiber has a low specific gravity presumably due to larger voids. This is demonstrated by H-7 and H-5. It is concluded that good drape and feel are obtained in the case where the microfine particles have an average particle diameter smaller than 1 μm and a true density higher than 2.5 and the polyester fiber has a specific gravity in excess of 1.425.

In the cases of A-7, A-5, C-7, and C-5, the surface irregularities were so small that they produced the color deepening effect but they were partly damaged, with the result that the dyed fabric looked partly whitish. A-7, A-5, and C-5 gave poor drape, but C-7 gave good drape.

The polyester fibers represented by A and C were examined for surface irregularities under a scanning electron microscope. The density of recesses was greater than 100 per 100 square microns.

In the cases of B-5, D-5, and E-5, the dyed fabrics were good in drape, hand, and silhouette. They produced the delustering effect, without giving rise to a whitish pastel shade. Barium sulfate (D) gave the best results among the microfine particles used.

What is claimed is:

1. An improved polyester fiber exhibiting a specific gravity of 1.430 to 1.600, said improvement comprising:
   (a) said fiber containing from 5–20 wt %, based on said polyester, of barium sulfate particles, said particles exhibiting an average diameter of less than 1 μm; and
   (b) said fiber exhibiting a roughened surface containing recesses therein, said recesses ranging from about 2 μm to 10 μm in length, the breadth of said recesses being greater than about 0.3 μm but less than about 2 μm, and the density of said recesses ranging from about 5 to about 100 per 100 square microns, thereby providing improved drape and silhouette to woven or knitted fabrics made therefrom.

2. The improved fiber of claim 1 wherein the specific gravity of said fiber is between 1.44 and 1.60 and wherein said fiber contains barium sulfate particles in an amount ranging from 7–20 wt % based on said polyester.

* * * * *